US009709256B2

(12) United States Patent
Chen

(10) Patent No.: US 9,709,256 B2
(45) Date of Patent: Jul. 18, 2017

(54) ELECTRICAL CONNECTING TERMINAL USED TO CONNECT DRIVING BOARD WITH LAMP HOLDER OF LED LAMP

(71) Applicant: Bingshui Chen, Xiamen (CN)

(72) Inventor: Bingshui Chen, Xiamen (CN)

( * ) Notice: Subject to any disclaimer, the term of this patent is extended or adjusted under 35 U.S.C. 154(b) by 0 days.

(21) Appl. No.: 15/041,984

(22) Filed: Feb. 11, 2016

(65) Prior Publication Data

US 2017/0023225 A1 Jan. 26, 2017

(30) Foreign Application Priority Data

Jul. 22, 2015 (CN) ..... 2015 2 0533819 U

(51) Int. Cl.

| | |
|---|---|
| ***H01R 33/02*** | (2006.01) |
| ***F21V 23/06*** | (2006.01) |
| ***F21V 23/00*** | (2015.01) |
| ***H01R 31/06*** | (2006.01) |
| *F21Y 101/02* | (2006.01) |

(52) U.S. Cl.

CPC ..... *F21V 23/06* (2013.01); *F21V 23/004* (2013.01); *H01R 31/06* (2013.01); *F21Y 2101/02* (2013.01)

(58) Field of Classification Search

CPC ..... H01R 33/02; H01R 33/05; H01R 31/06; H01R 12/716; H01R 12/712; H01R 12/718; H01R 23/7073; H01R 23/6893

See application file for complete search history.

(56) References Cited

U.S. PATENT DOCUMENTS

| | | | | |
|---|---|---|---|---|
| 4,471,414 | A * | 9/1984 | Savage, Jr. | F21S 8/00 362/311.01 |
| 6,250,970 | B1 * | 6/2001 | Key | H01R 33/06 439/699.2 |
| 7,341,371 | B2 * | 3/2008 | Kuo | F21V 19/001 362/545 |
| 8,491,324 | B1 * | 7/2013 | Yang | H01R 33/0836 439/226 |
| 8,668,507 | B2 * | 3/2014 | Yang | H01R 33/02 439/226 |
| 2006/0256566 | A1 * | 11/2006 | Beghelli | F21S 8/04 362/365 |
| 2009/0075519 | A1 * | 3/2009 | Daily | F21V 19/0025 439/620.02 |
| 2009/0128734 | A1 * | 5/2009 | Cho | G02F 1/133604 362/97.1 |
| 2012/0170261 | A1 * | 7/2012 | Hu | H01R 12/7076 362/217.16 |
| 2013/0084727 | A1 * | 4/2013 | Sartori | F21S 48/1168 439/271 |

* cited by examiner

*Primary Examiner* — Harshad Patel
(74) *Attorney, Agent, or Firm* — Leong C. Lei

(57) ABSTRACT

An electrical connecting terminal used to connect a driving board with a lamp holder of an LED lamp has a base, an elastic sheet, and a plug pin (or a weld pin). A side of the base extends upwards and obliquely and is curved to form the elastic sheet adapted for electrical connection of an electrode of the lamp holder. The side of the base extends outward or is bent to form the plug pin or the weld pin adapted for electrical connection of the driving board. The structure and connecting procedure are simple, the assembly efficiency is high, the connection is stable, and the yield is increased greatly.

13 Claims, 14 Drawing Sheets

ELECTRICAL CONNECTING TERMINAL USED TO CONNECT DRIVING BOARD WITH LAMP HOLDER OF LED LAMP

BACKGROUND OF THE INVENTION

1. Field of the Invention

The present invention relates to a power source connection technique of an LED lamp, and more particularly to an electrical connecting terminal used to connect a driving board with a lamp holder of an LED lamp.

2. Description of the Prior Art

In the existing technology, the driving board and the positive and negative electrodes of the lamp holder of an LED lamp are connected by using a guide wire. One end of the guide wire is welded to the driving board, and the other end of the guide wire is welded to the lamp holder, or the guide wire is suspended on the lamp adapter and then the lamp holder is locked to achieve an electrical connection. Such a connection by means of the guide wire, the working procedure is complicated and the assembly efficiency is low and the defect rate of the product is high. Accordingly, the inventor of the present invention has devoted himself based on his many years of practical experiences to solve these problems.

SUMMARY OF THE INVENTION

The primary object of the present invention is to provide an electrical connecting terminal used to connect a driving board with a lamp holder of an LED lamp. Its structure and connecting procedure are simple, and the connection is stable.

In order to achieve the aforesaid object, the electrical connecting terminal used to connect a driving board with a lamp holder of an LED lamp has a base, an elastic sheet, and an electrical connecting pin (a plug pin or a weld pin). A side of the base extends upwards and obliquely and is curved to form the elastic sheet adapted for electrical connection of an electrode of the lamp holder. The side of the base, extending outward or being bent, is formed with the electrical connecting pin adapted for electrical connection of the driving board.

The structure of the present invention is simple. When installed, the electrical connecting terminal is installed on the driving board in advance. Along with the installation of the driving board, the electrical connecting terminal is disposed in the lamp adapter. When the lamp holder is installed, the positive electrode of the lamp holder is elastically in contact with the elastic sheet of the positive electrode connecting terminal to achieve positive electrode electrical connection. At the same time, the elastic sheet of the negative electrode connecting terminal is compressed to contact with the negative electrode of the lamp holder to achieve negative electrode electrical connection. The connecting procedure is simple, the assembly efficiency is high, the connection is stable, and the yield is increased greatly.

DETAILED DESCRIPTION OF THE PREFERRED EMBODIMENTS

Embodiments of the present invention will now be described, by way of example only, with reference to the accompanying drawings.

Figure 1:
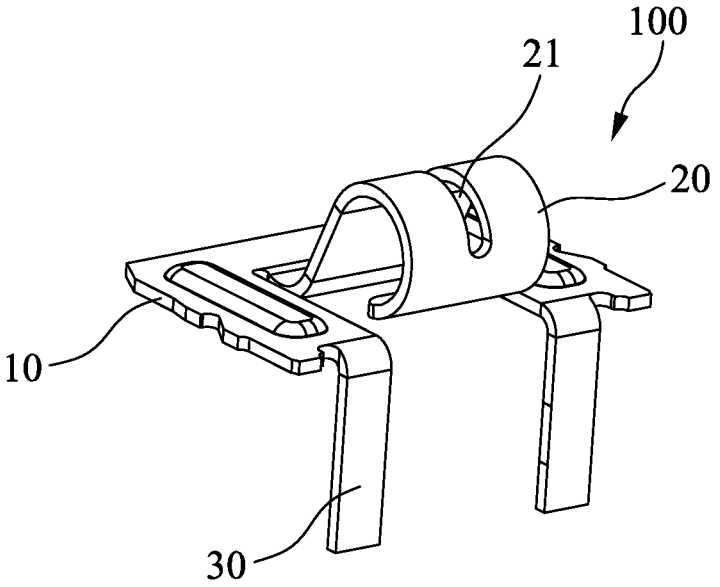
FIG. 1 to FIG. 4 are schematic views of the first to fourth embodiments of the present invention as a positive electrode connecting terminal.
Figure 2:
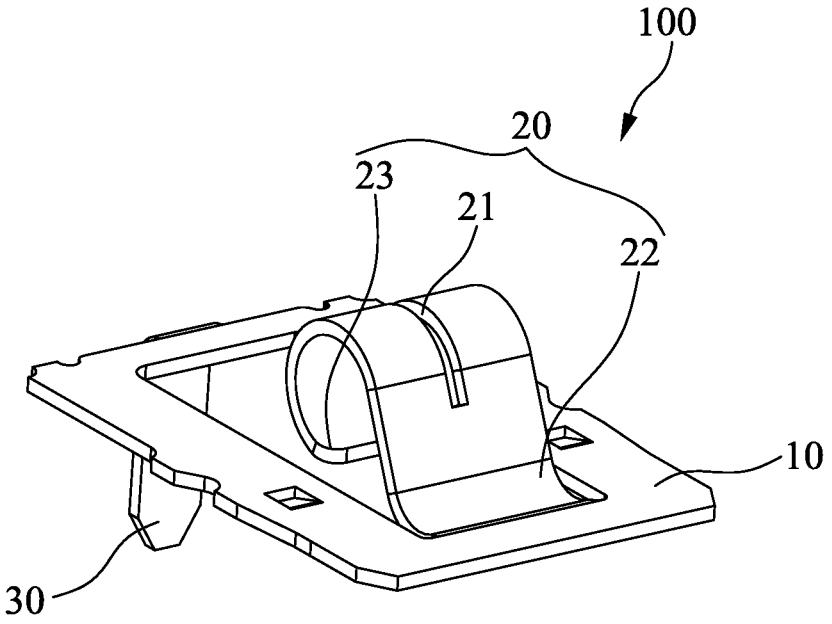
Figure 3:
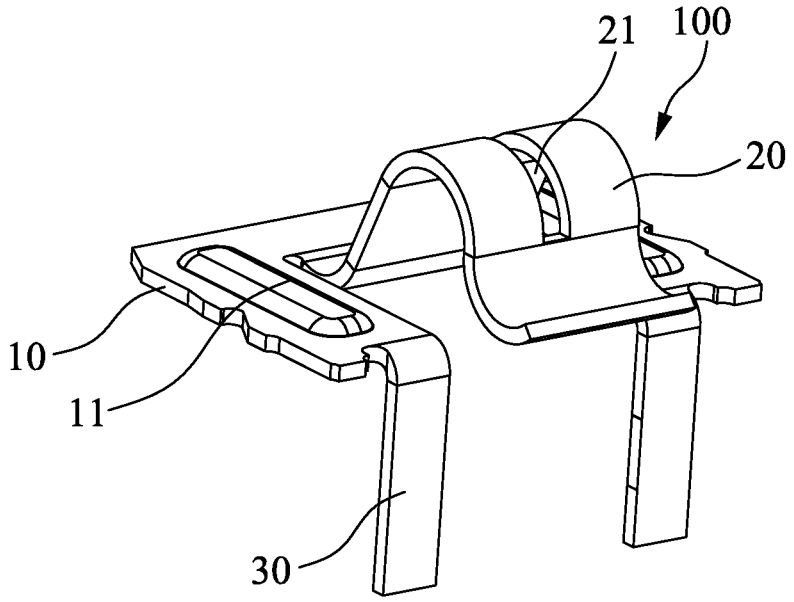
Figure 4:
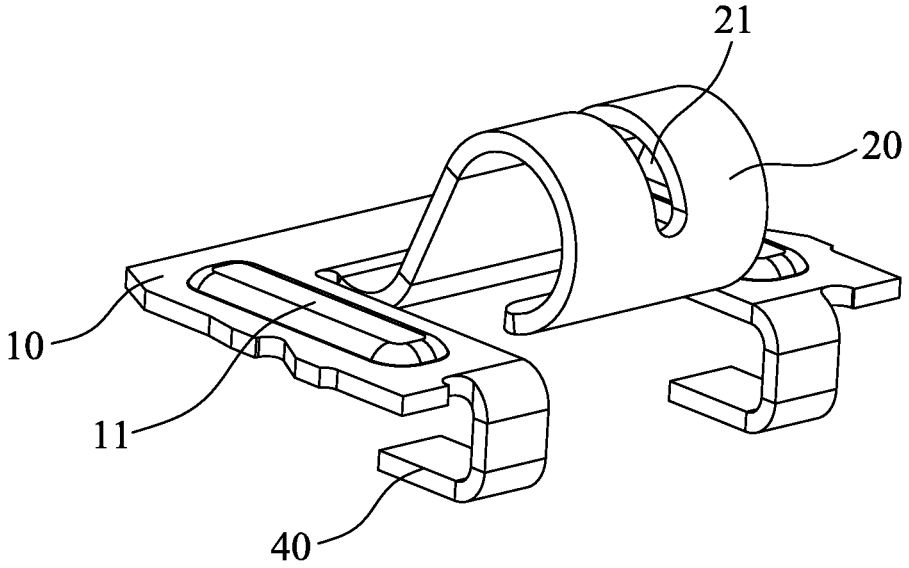
Figure 5:
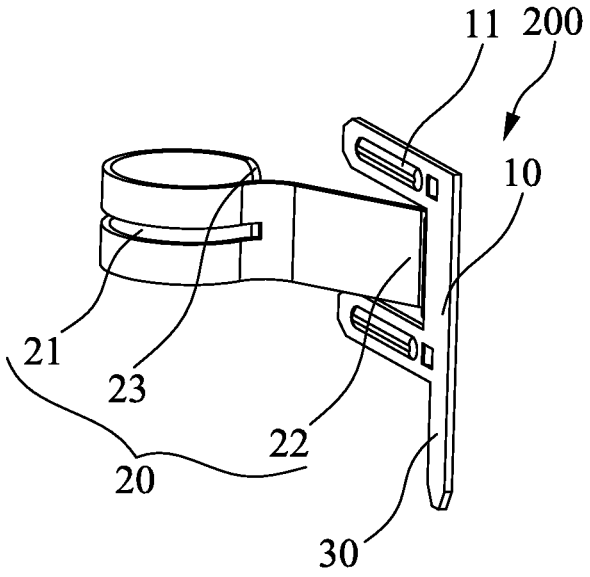
FIG. 5 to FIG. 7 are schematic views of the first to third embodiments of the present invention as a negative electrode connecting terminal.
Figure 6:
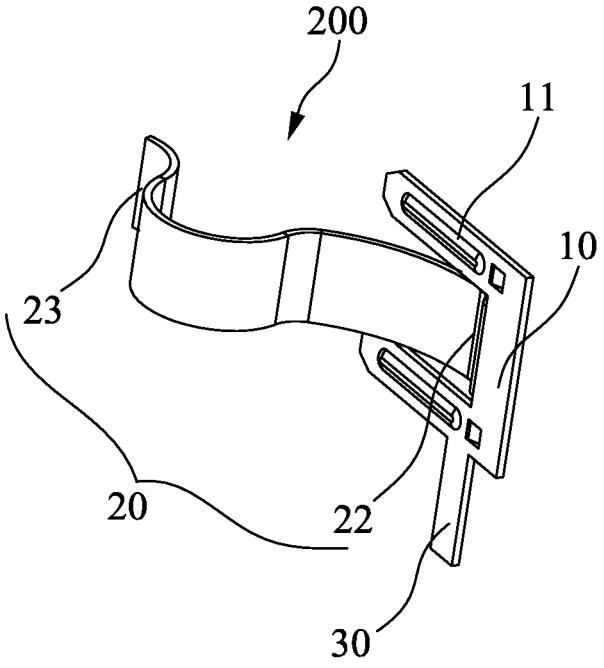
Figure 7:
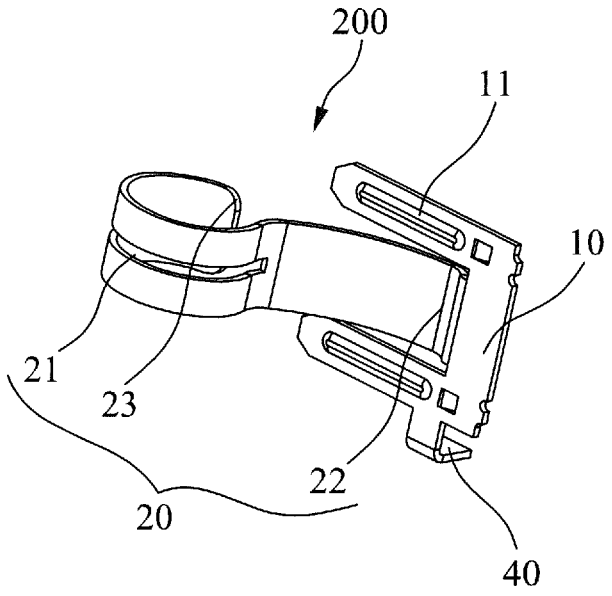
Figure 21:
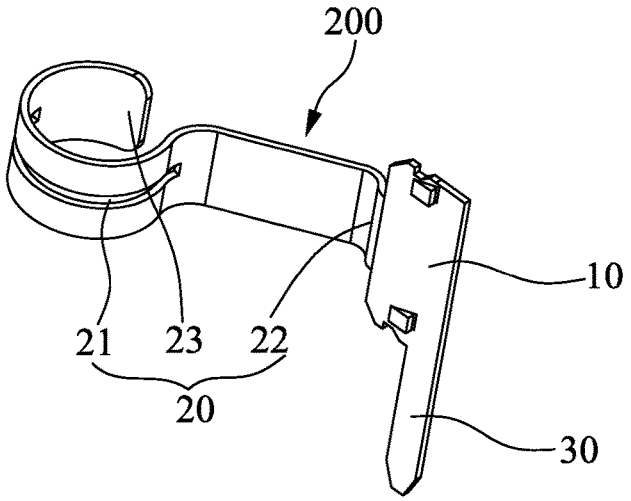
FIG. 21 is a schematic view of the fourth embodiment of the present invention as a negative electrode connecting terminal.
Figure 22:
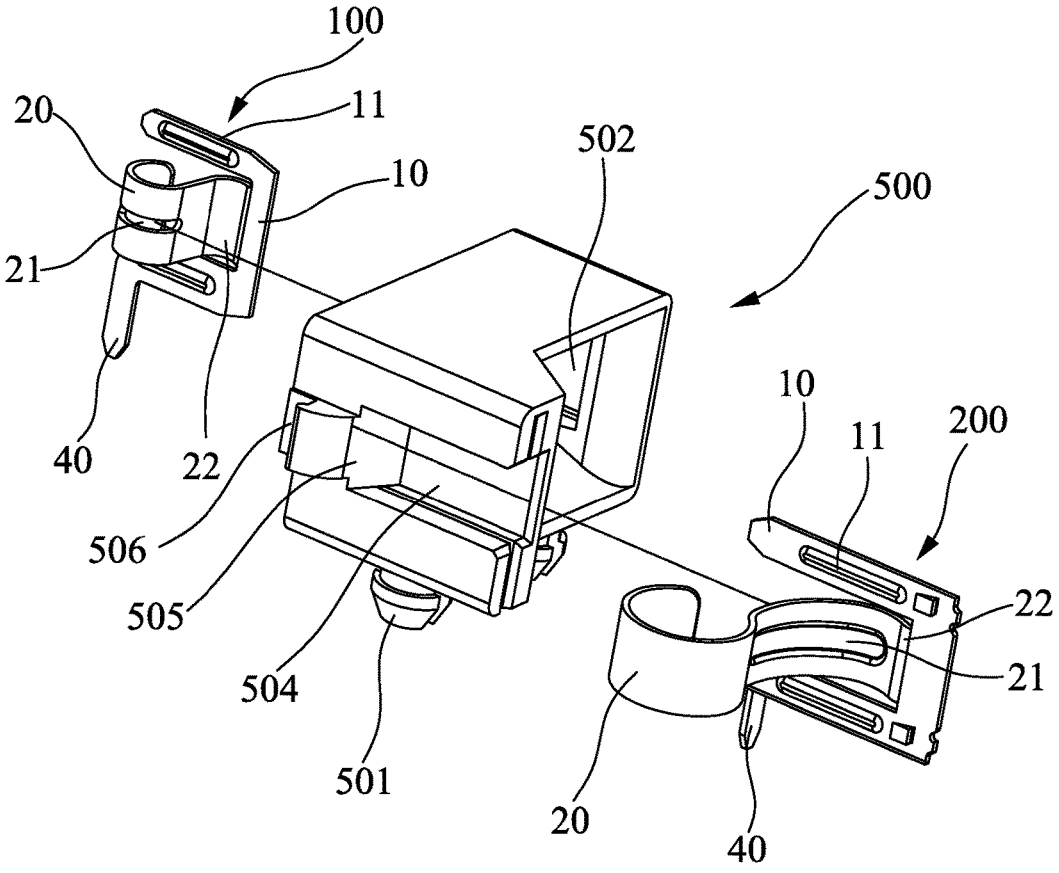
FIG. 22 to FIG. 28 are schematic views of preferred embodiments the present invention.
Figure 23:
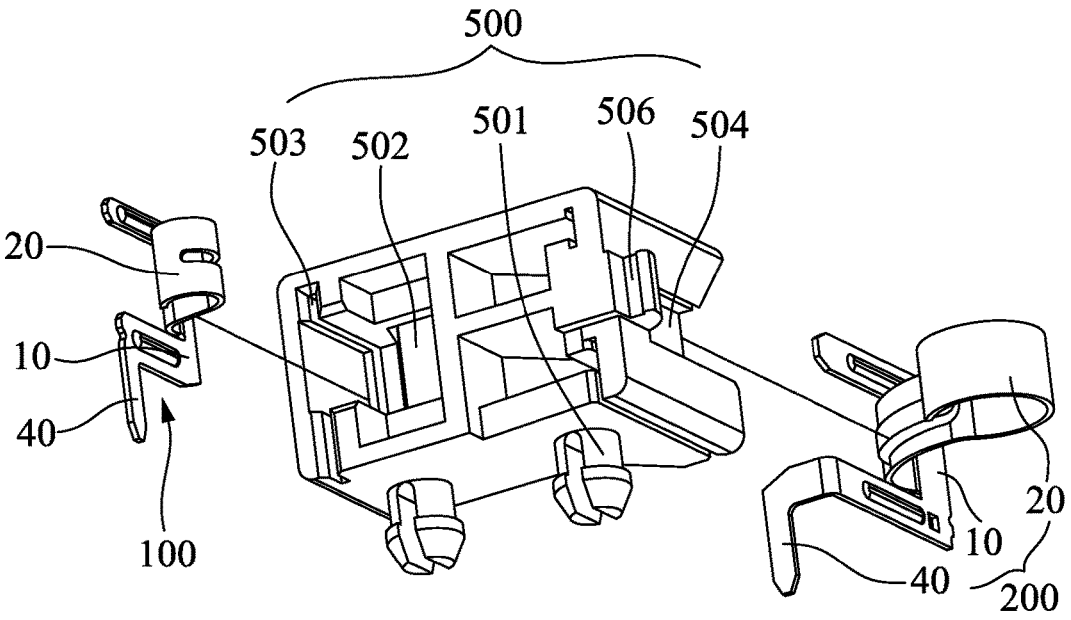
Figure 24:
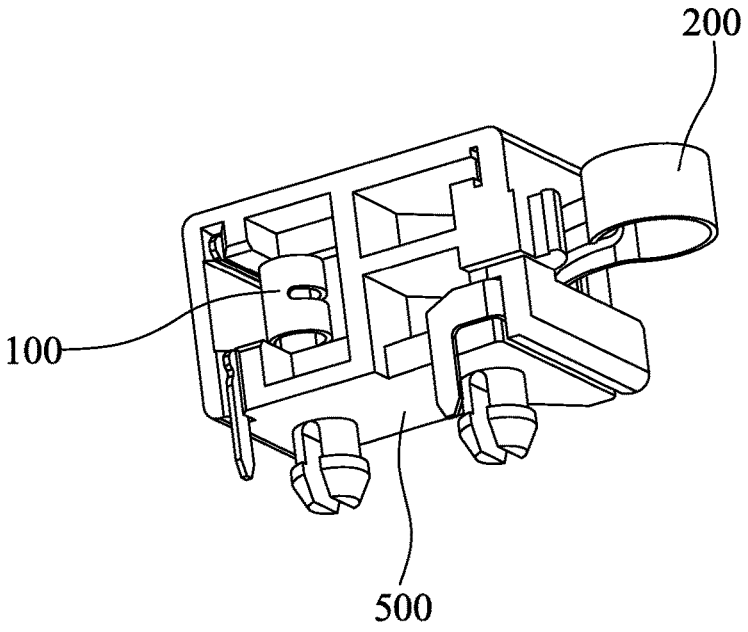
Figure 25:
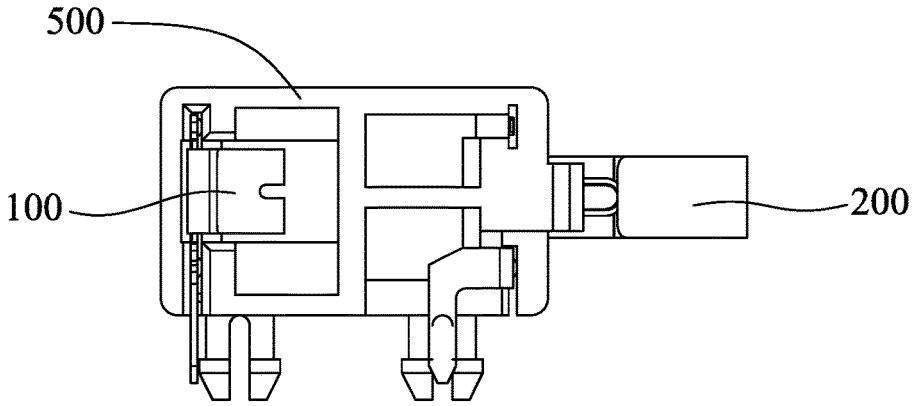
Figure 26:
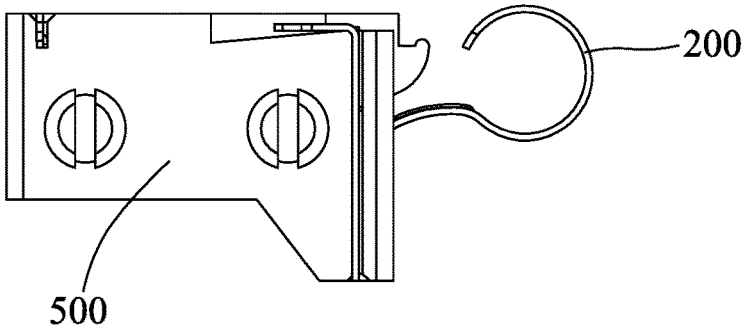
Figure 27:
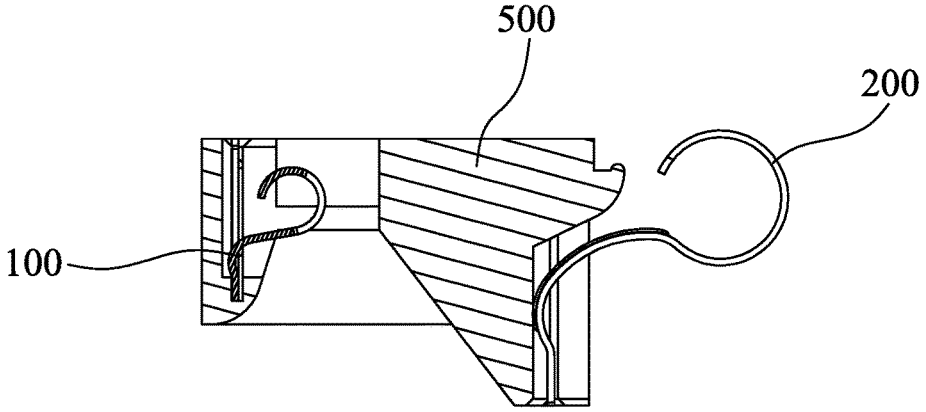
Figure 28:
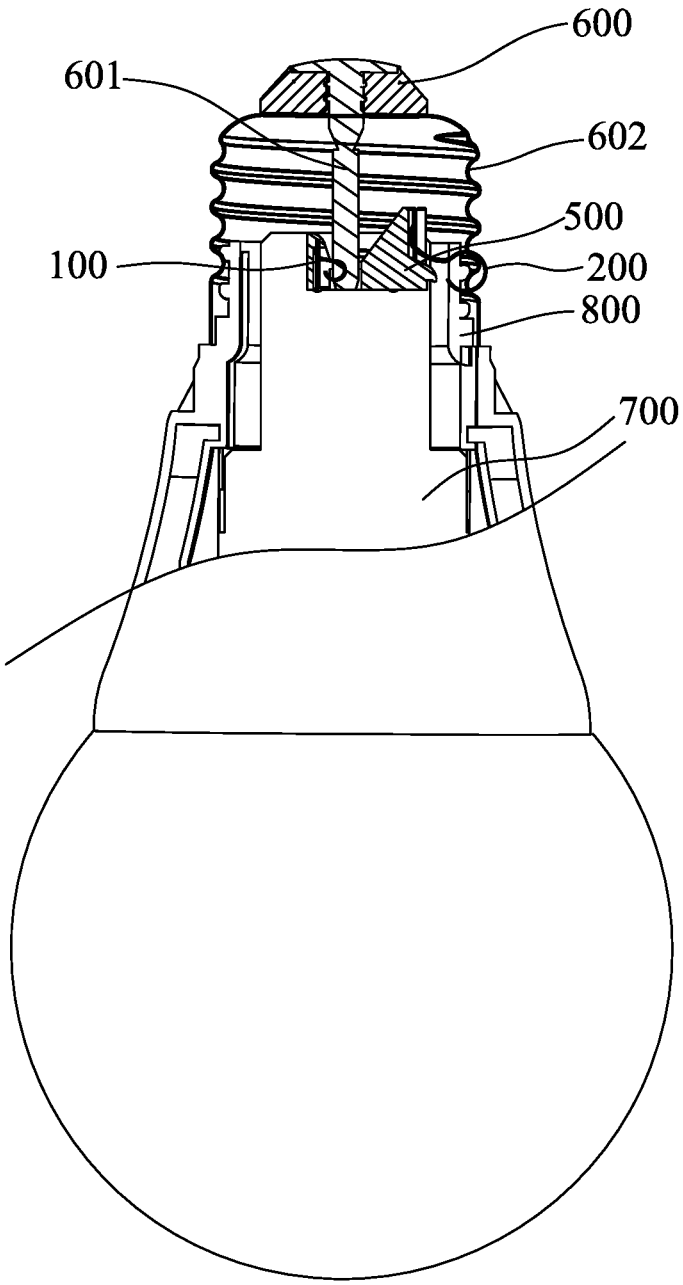

As shown in FIG. 1 through FIG. 7, the present invention discloses an electrical connecting terminal used to connect a driving board with a lamp holder of an LED lamp. The electrical connecting terminal has a base 10, an elastic sheet 20, and a plug pin 30 (or a weld pin 40). The base 10 can be a single plate (as shown in FIG. 21) or a frame in a ⊔ shape or in a □ shape as shown in FIG. 2. In order to enhance the firmness of installation, the base 10 is formed with raised ribs 11. A side of the base 10 extends upwards and obliquely and is curved to form the elastic sheet 20. The elastic sheet 20 is adapted for electrical connection of an electrode of a lamp holder 600. In order to increase contact points, the elastic sheet 2 is formed with a groove 21. The side of the base 10 extends outward to form the plug pin 30 (as shown in FIGS. 1, 2, 3, 5, 6 and 21). The plug pin 30 is adapted for electrical connection of a driving board 700. Alternatively, the side of the base 10 extends outward and is bent to form the weld pin 40 (as shown in FIG. 4 and FIG. 7). The weld pin 40 is adapted for electrical connection of the driving board 700.

The electrical connecting terminal, as shown in FIG. 1 through FIG. 4, functions as a positive electrode connecting terminal 100 for connection of the driving board 700 and the positive electrode of the lamp holder 600. The elastic sheet 20 and the plug pin 30 (or the weld pin 40) are formed on the side of the base 10. The plug pin 30 (or the weld pin 40) is disposed close to a head portion 23 of the elastic sheet 20 and apart from a root portion 22 of the elastic sheet 20. For the base 10 in a frame shape, the elastic sheet 20 and the plug pin 30 (or the weld pin 40) are formed on two opposing sides of the base 10.

The electrical connecting terminal, as shown in FIGS. 5, 6, 7, and 21, functions as a negative electrode connecting terminal 200 for connection of the driving board 700 and the negative electrode of the lamp holder 600. The elastic sheet 20 and the plug pin 30 (or the weld pin 40) are formed on the side of the base 10. The plug pin 30 (or the weld pin 40) is disposed close to the root portion 22 of the elastic sheet 20. For the base 10 in a frame shape, the elastic sheet 20 and the plug pin 30 (or the weld pin 40) are formed on the same side of the base 10.

As shown in the drawings, the positive electrode connecting terminal 100 and the negative electrode connecting terminal 200 are directly formed by punching a platy material. As shown in FIG. 1 through FIG. 7, the middle of the platy material is formed with the elastic sheet 20, one side or two sides of the platy material are formed with the plug pin 30 (or the weld pin 40). This saves the material greatly.

When the aforesaid electrical connecting terminal is applied for electrical connection of the driving board 700 and the lamp holder 600, the positive electrode connecting terminal 100 and the negative electrode connecting terminal 200 can be installed by means of respective plastic cores (as shown in FIG. 8 through FIG. 13 and FIG. 18) or installed by means of a common plastic core (as shown in FIG. 14 through FIG. 17, FIG. 19 and FIG. 20).

Figure 8:
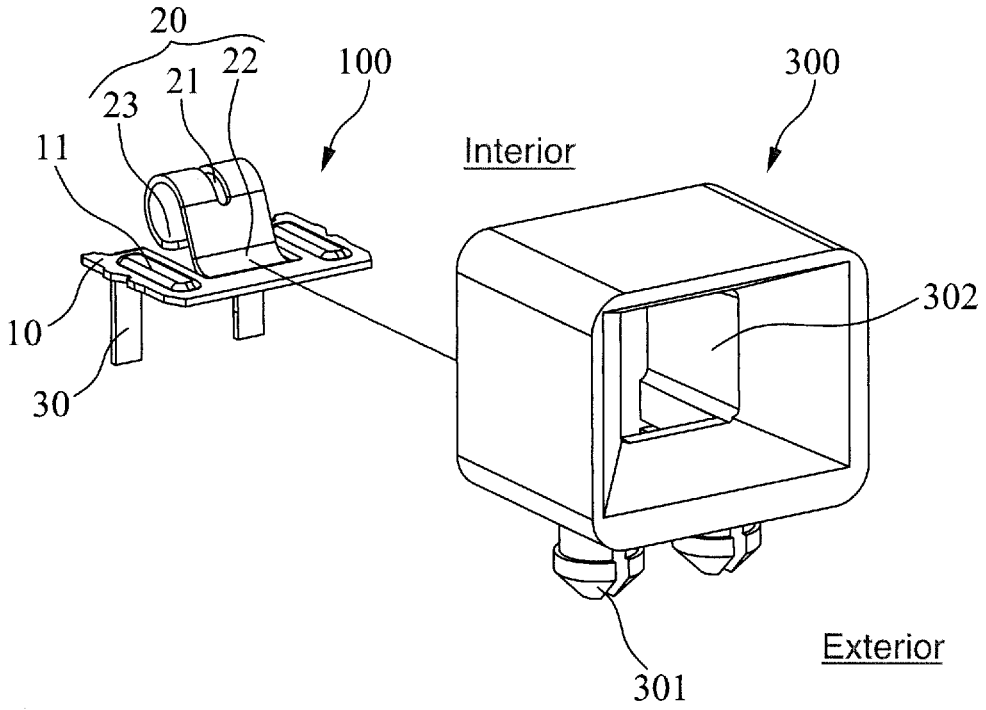
FIG. 8 to FIG. 10 are schematic views of the first embodiment of the present invention as a positive electrode connecting terminal in cooperation with a plastic core.
Figure 9:
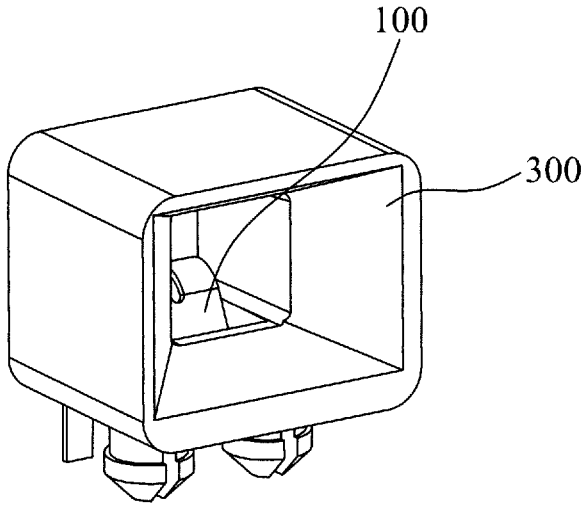
Figure 10:
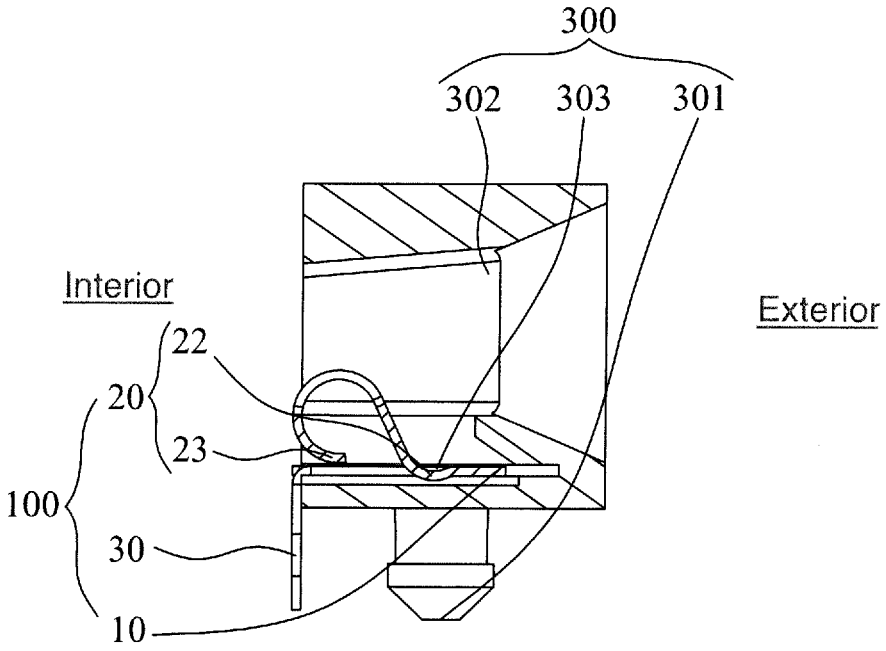

As shown in FIG. 8 through FIG. 10, the present invention discloses a positive electrode connector which is an electrical connector used to connect a driving board with the positive electrode of a lamp holder of an LED lamp. The positive electrode connector comprises a positive electrode plastic core 300 and a positive electrode connecting terminal 100. The positive electrode plastic core 300 is fixed on the driving board 700 through a protruding post 301. The positive electrode plastic core 300 is formed with an insertion hole 302 for insertion of a positive electrode 601 of the lamp holder. (The insertion hole 302 is a flared hole for guiding insertion of the positive electrode 601 of the lamp holder.) A side of the insertion hole 302 is formed with a side trough 303 in communication with the insertion hole 302. The base 10 of the positive electrode connecting terminal 100 is inserted into the side trough 303 from the inside of the LED lamp towards the lamp holder 600. (The direction is opposite to the insertion direction of the positive electrode 601 of the lamp holder). The elastic sheet 20 and the plug pin 30 (or the weld pin 40) are formed on the side of the base 10 towards the inside of the LED lamp. The plug pin 30 (or the weld pin 40) is exposed out of the positive electrode plastic core 300 for electrically connecting with the driving board 700. The elastic sheet 20 is formed on the side of the base 10 towards the lamp holder 600. (The plug pin 30 or the weld pin 40 is disposed close to the head portion 23 of the elastic sheet 20 and apart from the root portion 22 of the elastic sheet 20.) The elastic sheet 20 is inserted into the insertion hole 302 and extends and curves towards the inside of the LED lamp. The elastic sheet 20 is elastically in contact with the positive electrode 601 of the lamp holder (inserted in the insertion hole 302) to achieve electrical connection.

Figure 11:
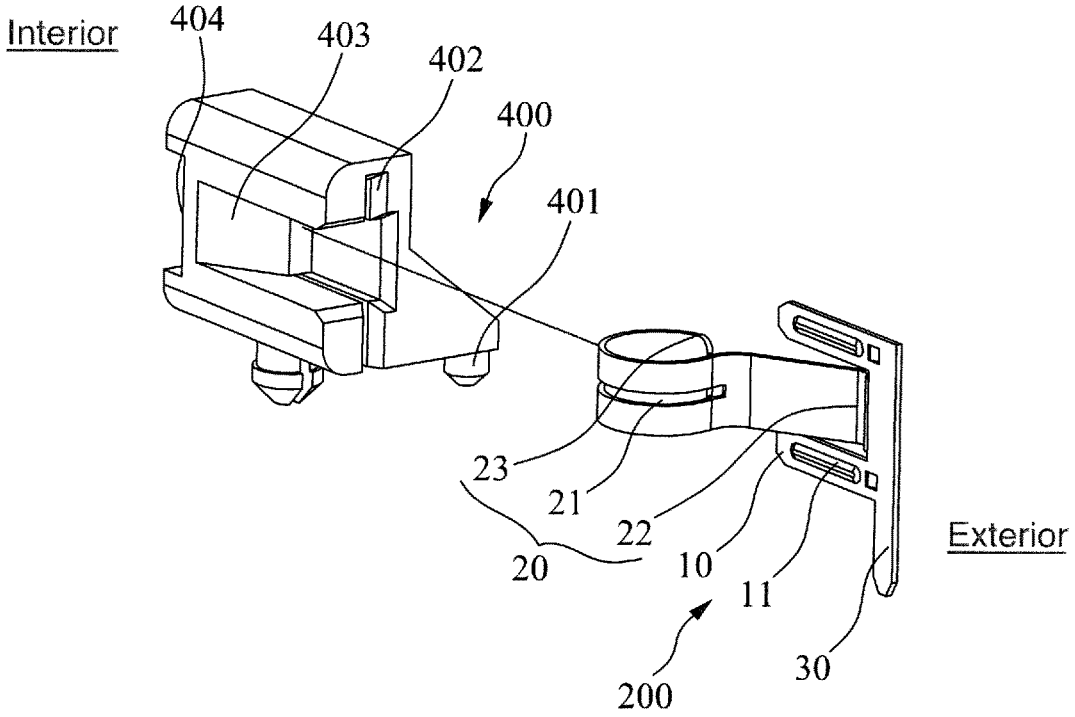
FIG. 11 to FIG. 13 are schematic views of the first embodiment of the present invention as a negative electrode connecting terminal in cooperation with a plastic core.
Figure 12:
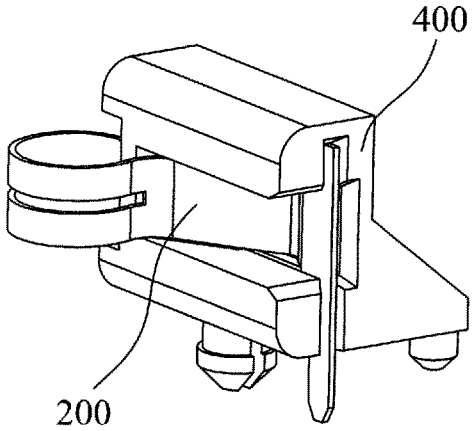
Figure 13:
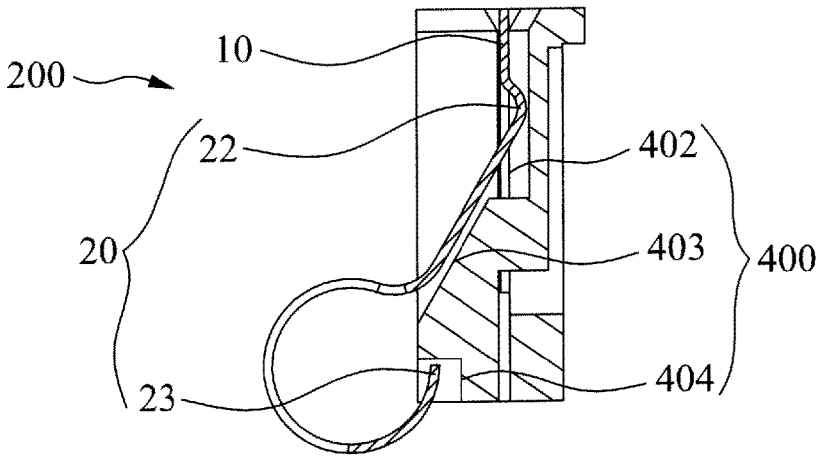
Figure 14:
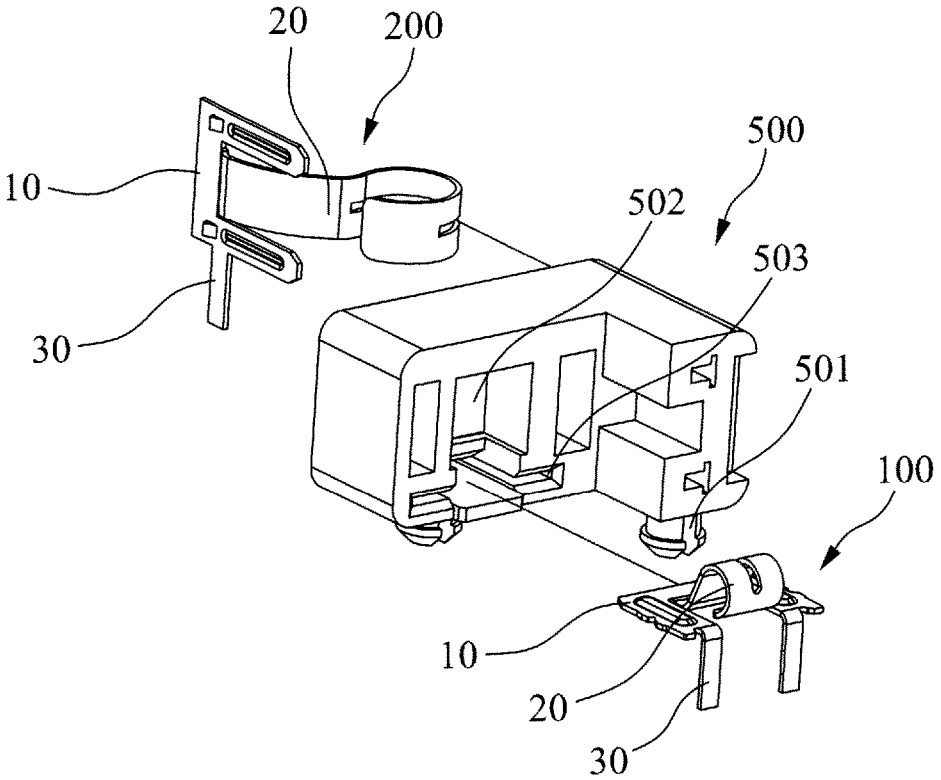
FIG. 14 to FIG. 17 are schematic views of the present invention in cooperation with an integral plastic core.
Figure 15:
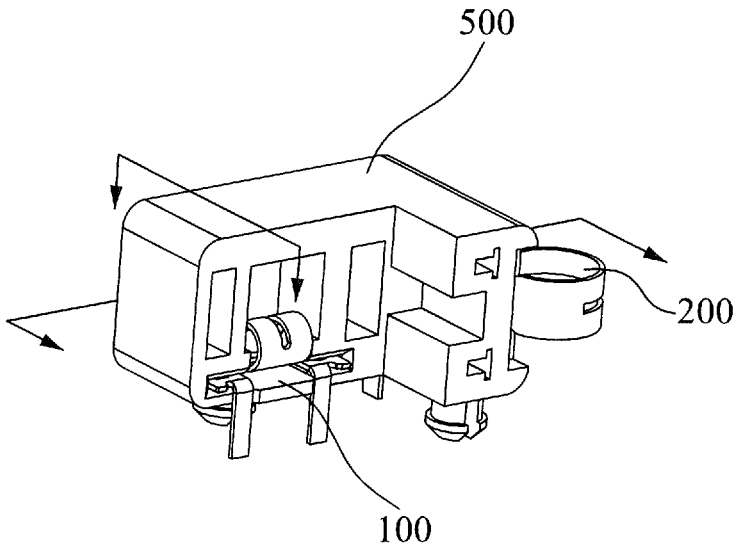
Figure 16:
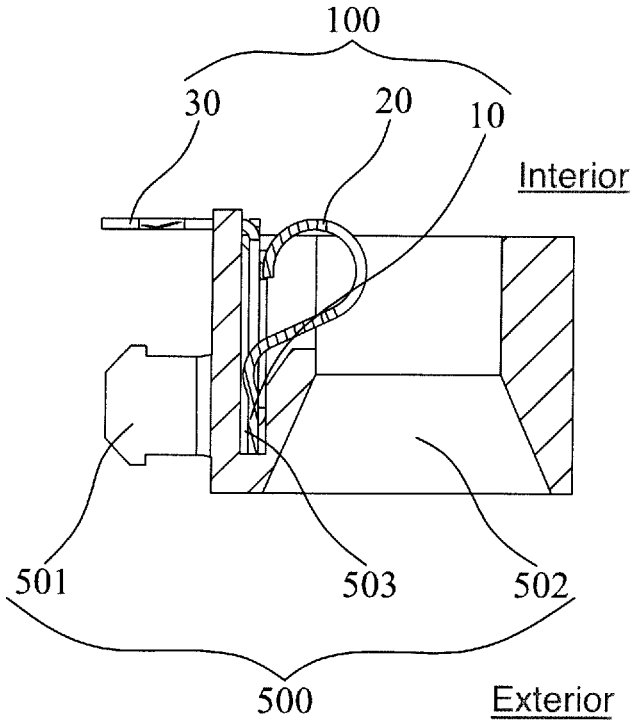
Figure 17:
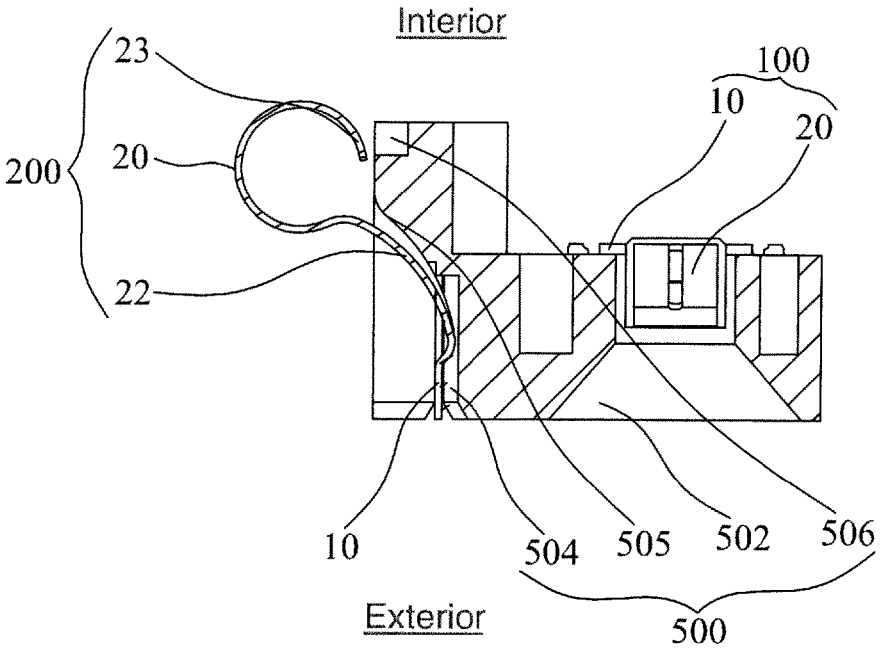

As shown in FIG. 11 through FIG. 13, the present invention discloses a negative electrode connector which is an electrical connector used to connect a driving board with the negative electrode of a lamp holder of an LED lamp. The positive electrode connector comprises a negative electrode plastic core 400 and a negative electrode connecting terminal 200. The negative electrode plastic core 400 is fixed on the driving board 700 through a protruding post 401. The negative electrode plastic core 400 is formed with an insertion slot 402. An outer wall of the insertion slot 402 is formed with an oblique surface 103 and a step 404. The base 10 of the negative electrode connecting terminal 200 is inserted into the insertion slot 402 from the lamp holder 600 towards the inside of the LED lamp. (The direction is the same as the insertion direction of the positive electrode 601 of the lamp holder.) The plug pin 30 (or the weld pin 40) is formed on the side of the base 10 towards the lamp holder 600. The plug pin 30 (or the weld pin 40) is exposed out of the negative electrode plastic core 400 for electrically connecting with the driving board 700. The elastic sheet 20 is also formed on the side of the base 10 towards the lamp holder 600. (The plug pin 30 or the weld pin 40 is disposed close to the root portion 22 of the elastic sheet 20.) The elastic sheet 20 extends out of the insertion slot 402 and curves towards the inside of the LED lamp. The elastic sheet 20 is elastically in contact with the positive electrode 601 of the lamp holder (inserted in the insertion hole 302) to achieve electrical connection. The root portion 22 (the elastic arm 22) of the elastic sheet 20 is against the oblique surface 403, or the head portion 23 of the elastic sheet 20 is against the outer wall of the insertion slot 402, providing a support for the elastic sheet 20 and preventing the elastic sheet 20 from being pressed and deformed so as to ensure electrical connection. The elastic sheet 20 is elastically in contact with the negative electrode 602 of the lamp holder by a spiral compression to achieve electrical connection. The head portion 23 of the elastic sheet 20 is spirally compressed to hook the step 404. For the embodiment as shown in FIG. 5 and FIG. 7, the head portion 23 is curved inwards, so the step 404 is formed at the end of the outer wall of the insertion slot 402. For the embodiment as shown in FIG. 6, the head portion 23 is curved outwards, so the step 404 is formed at the middle of the outer wall of the insertion slot 402.

Figure 18:
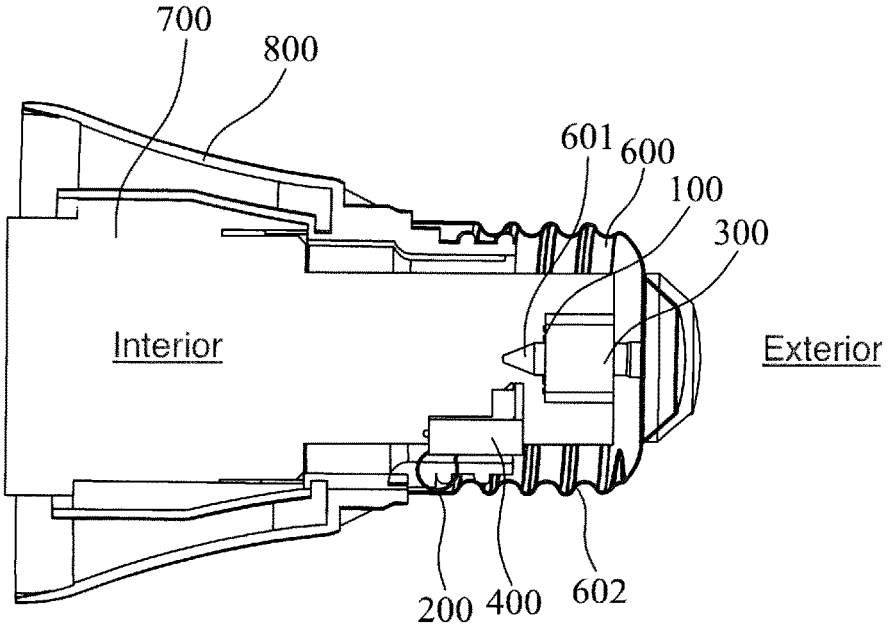
FIG. 18 is a sectional view of the assembled LED lamp of FIG. 8 and FIG. 11.

The positive electrode connecting terminal 100 and the negative electrode connecting terminal 200 can be applied to an LED lamp. As shown in FIG. 18, the present invention discloses an LED lamp. The LED lamp is composed of a lampshade, a light source board, a driving board 700, a lamp adapter 800, and a lamp holder 600. The lampshade is installed on the lamp adapter. The light source board is installed in the lampshade. The light source board is electrically connected with the driving board 700. The lampshade and the light source board belong to the normal components of the LED lamp, not shown in the drawings. The features of the LED lamp are that the driving board is installed with the positive electrode connector and the negative electrode connector, respectively. The driving board 700 is fixedly inserted in the lamp adapter 800. The lamp holder 600 is fitted on the lamp adapter 800. The positive electrode 601 of the lamp holder is inserted into the insertion hole 302 and electrically in contact with the elastic sheet 20 of the positive electrode connecting terminal 100 to achieve positive electrode electrical connection. The negative electrode 602 of the lamp holder compresses the elastic sheet 20 of the negative electrode connecting terminal 200 to achieve negative electrode electrical connection.

As shown in FIG. 14 through FIG. 17, the present invention discloses an integral connector which is an electrical connector used to connect a driving board with a lamp holder of an LED lamp. The integral connector comprises an integral plastic core 500, a negative electrode connecting terminal 100, a negative electrode connecting terminal 200. The integral plastic core 500 is fixed on the driving board 700 through a protruding post 501. The integral plastic core 500 is formed with an insertion hole 502 for insertion of a positive electrode 601 of the lamp holder. (The insertion hole 502 is a flared hole for guiding insertion of the positive electrode 601 of the lamp holder.) A side of the insertion hole 502 is formed with a side trough 503 in communication with the insertion hole 502. The integral plastic core 500 is further formed with an insertion slot 504. An outer wall of the insertion slot 504 is formed with an oblique surface 505 and a step 506. The electrical connecting terminal is composed of the negative electrode connecting terminal 100 and the negative electrode connecting terminal 200. The base 10 of the positive electrode connecting terminal 100 is inserted into the side trough 503 from the inside of the LED lamp towards the lamp holder 600. (The direction is opposite to the insertion direction of the positive electrode 601 of the lamp holder). The plug pin 30 (or the weld pin 40) is formed on the side of the base 10 towards the inside of the LED lamp. The plug pin 30 (or the weld pin 40) is exposed out of the integral plastic core 500 for electrically connecting with the driving board 700. The elastic sheet 20 is formed on the side of the base 10 towards the lamp holder 600. The elastic sheet 20 is inserted into the insertion hole 502 and extends and curves towards the inside of the LED lamp. The elastic sheet 20 is elastically in contact with the positive electrode 601 of the lamp holder (inserted in the insertion hole 502) to achieve electrical connection. The base 10 of the negative electrode connecting terminal 200 is inserted into the insertion slot 504 from the lamp holder 600 towards the inside of the LED lamp. (The direction is the same as insertion of the positive electrode 601 of the lamp holder.) The plug pin 30 (or the weld pin 40) is formed on the side of the base 10 towards the lamp holder 600. The plug pin 30 (or the weld pin 40) is exposed out of the integral plastic core 500 for electrically connecting with the driving board 700. The elastic sheet 20 is also formed on the side of the base 10 towards the lamp holder 600. The elastic sheet 20 extends out of the insertion slot 504 and curves towards the inside of the LED lamp. The root portion 22 (the elastic arm 22) of the elastic sheet 20 is against the oblique surface 505, or the head portion 23 of the elastic sheet 20 is against the outer wall of the insertion slot 504. The elastic sheet 20 is elastically in contact with the negative electrode 602 of the lamp holder by a spiral compression to achieve electrical connection. The head portion 23 of the elastic sheet 20 is spirally compressed to hook the step 506.

Figure 19:
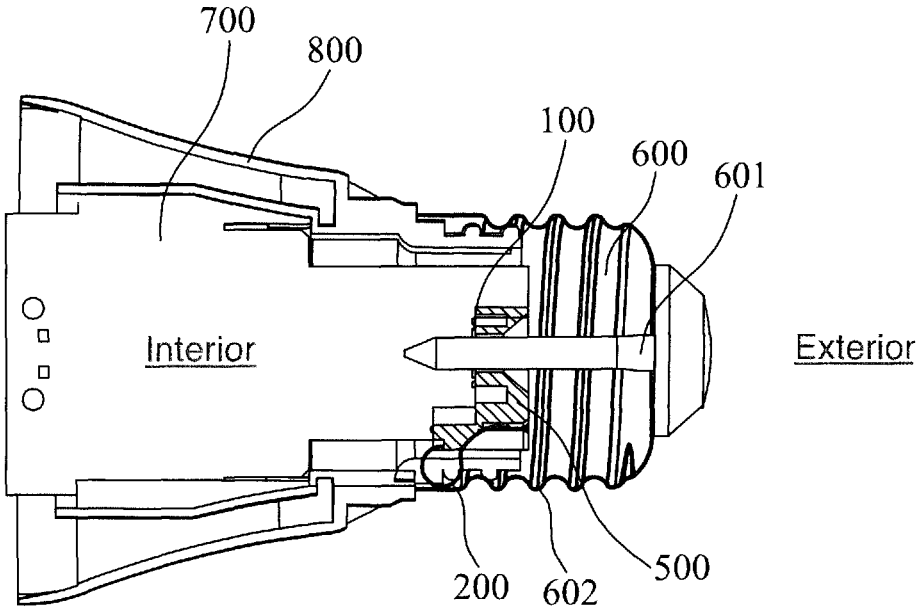
FIG. 19 and FIG. 20 are sectional views of the assembled LED lamp of FIG. 14.
Figure 20:
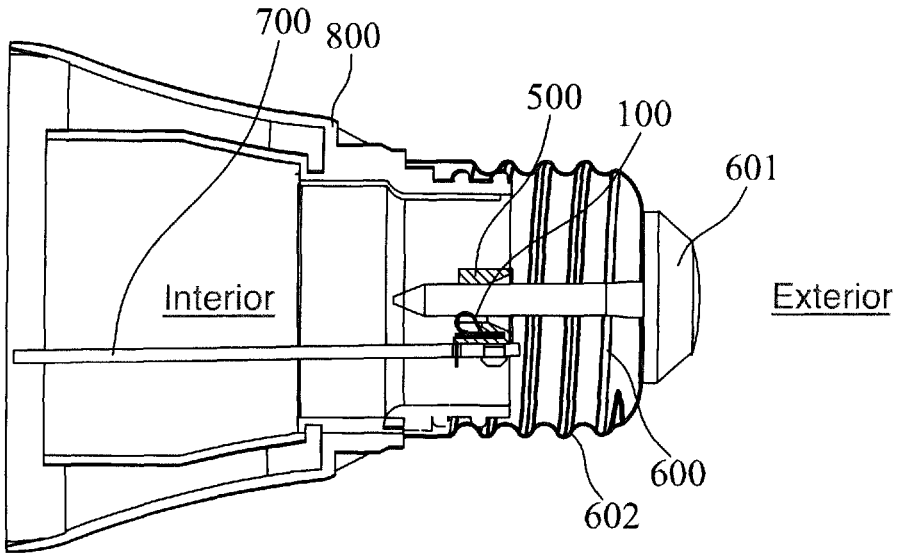

The positive electrode connecting terminal 100 and the negative electrode connecting terminal 200 are integrally installed on the LED lamp. As shown in FIG. 19 and FIG. 20, the present invention discloses another LED lamp. Except the installation way, this LED lamp has the same electrical connecting structure as the LED lamp as shown in FIG. 18.

In order to explain the electrical connector and the LED lamp conveniently, the first embodiment of the negative electrode connecting terminal and the first embodiment of the negative electrode connecting terminal are described and shown as an example. The other embodiments to cooperate with the plastic core are identical to the first embodiment of the positive and negative electrode connecting terminals, and won't be described hereinafter.

FIG. 22 through FIG. 28 shows preferred embodiments of the present invention. The main structures of the positive electrode connecting terminal 100 and the negative electrode connecting terminal 200 are substantially similar to the aforesaid connecting terminals with the exceptions described hereinafter. The positive electrode connecting terminal 100 is vertically installed in the integral plastic core 500. After the negative electrode connecting terminal 200 is installed in the integral plastic core 500, the weld pin 40 is bent. This is convenient for installation and the electrical connection is more reliable.

The elastic sheet 200 of the present invention is bent to form a curved shape, which can have even stress and better elasticity. The insertion direction of the positive electrode connecting terminal 100 and the plastic core is opposite to the insertion direction of the positive electrode 601 of the lamp holder. The insertion direction of the negative electrode connecting terminal 200 and the plastic core is the same as the insertion direction of the positive electrode 601 of the lamp holder. When the positive electrode 601 of the lamp holder is inserted, the positive electrode 601 of the lamp holder compresses the elastic sheet 20 of the positive electrode connecting terminal 100. The direction of the compression force applied to the elastic sheet 20 is perpendicular to the driving board 70. The head portion of the elastic sheet 20 holds against the plastic core to increase its elasticity and won't be damaged so as to ensure the electrical connection. When the negative electrode 602 of the lamp holder is screwedly tightened, the negative electrode 602 of the lamp holder, the negative electrode 602 of the lamp holder compresses the elastic sheet 20 of the negative electrode connecting terminal 200. The direction of the compression force applied to the elastic sheet 20 is transversely parallel to the driving board 70. The oblique surface 403 provides a support for the elastic sheet 20, preventing the elastic sheet 20 from be pressed and deformed so as to ensure the electrical connection. Before the driving board 700 is inserted into the lamp holder 600, the negative electrode 602 of the lamp holder is not in contact with the elastic sheet 20 of the negative electrode connecting terminal 200 and the head portion 23 of the elastic sheet 20 is lifted and not mated with the step. After the driving board 700 is inserted into the lamp holder 600, the negative electrode 602 of the lamp holder is in contact with the elastic sheet 20 of the negative electrode connecting terminal 200, the elastic sheet 20 is pressed downward, and the head portion 23 of the elastic sheet 20 is to hook the step. Thus, when the driving board 700 is pulled out, the elastic sheet 20 of the negative electrode connecting terminal 200 won't be retracted easily and damaged.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electrical connection arrangement comprising an electrical connecting terminal for connecting a driving board with a lamp holder of an LED lamp, wherein a lamp adaptor is mounted to the lamp holder to receive and fix the driving board in a space formed in an interior of the lamp adaptor, the electrical connecting terminal comprising a base, an elastic sheet, and an electrical connecting pin, a side of the base extending upwards and obliquely and being curved to form the elastic sheet for electrical connection of a positive electrode of the lamp holder, the side of the base being formed with the electrical connecting pin for electrical connection of the driving board, wherein the electrical connecting terminal functions as a positive electrode connecting terminal for connection of the driving board and the positive electrode of the lamp holder and cooperates with a positive electrode plastic core; the positive electrode plastic core is fixed on the driving board, the positive electrode plastic core is formed with an insertion hole for insertion of the positive electrode of the lamp holder, a side of the insertion hole is formed with a side trough in communication with the insertion hole; the base of the positive electrode connecting terminal is inserted into the side trough in a direction from the interior of the lamp adaptor of the LED lamp towards the lamp holder; the electrical connecting pin is formed on the side of the base towards the interior of the lamp adaptor of the LED lamp, the electrical connecting pin is exposed out of the positive electrode plastic core for electrically connecting with the driving board, the elastic sheet is formed on the side of the base towards the lamp holder, the elastic sheet is inserted into the insertion hole and extends and curves towards the interior of the lamp adaptor of the LED lamp, and the elastic sheet is elastically in contact with the positive electrode inserted in the insertion hole for electrical connection such that the elastic sheet is deformable in a direction away from the interior of the lamp adaptor and toward the driving board.

2. The electrical connecting arrangement as claimed in claim 1, wherein the base has a frame shape.

3. The electrical connection arrangement as claimed in claim 1, wherein the elastic sheet and the electrical connecting pin of the electrical connecting terminal are formed on the side of the base, and the electrical connecting pin is disposed close to a head portion of the elastic sheet and apart from a root portion of the elastic sheet.

4. The electrical connection arrangement as claimed in claim 1, wherein the elastic sheet has a curved shape, and the elastic sheet is formed with a groove.

5. An electrical connection arrangement comprising an electrical connecting terminal for connecting a driving board with a lamp holder of an LED lamp, wherein a lamp adaptor is mounted to the lamp holder to receive and fix the driving board in a space formed in an interior of the lamp adaptor, the electrical connecting terminal comprising a base, an elastic sheet, and an electrical connecting pin, a side of the base extending upwards and obliquely and being curved to form the elastic sheet engageable with a negative electrode of the lamp holder for electrical connection therewith, the side of the base being formed with the electrical connecting pin mounted to and electrically connected with the driving board; the electrical connecting terminal functions as a negative electrode connecting terminal for connection of the driving board and the negative electrode of the lamp holder and cooperates with a negative electrode plastic core; the negative electrode plastic core is fixed on the driving board, the negative electrode plastic core is formed with an insertion slot, an outer wall of the insertion slot is formed with an oblique surface and a step; the base of electrical connecting terminal is inserted into the insertion slot in a direction from the lamp holder towards the interior of the lamp adaptor of the LED lamp, the electrical connecting pin is formed on the side of the base towards the lamp, the electrical connecting pin is exposed out of the negative electrode plastic core for electrically connecting with the driving board, the elastic sheet is formed on the side of the base towards the lamp holder, the elastic sheet extends out of the insertion slot and curves towards the interior of the lamp adaptor of the LED lamp, a root portion of the elastic sheet is against the outer wall of the insertion slot or a head portion of the elastic sheet is against the outer wall of the insertion slot, the elastic sheet is elastically in contact with the negative electrode of the lamp holder for electrical connection, and the head portion of the elastic sheet is engageable with and hook the step of the outer wall of the insertion slot.

6. The electrical connection arrangement as claimed in claim 5, wherein the elastic sheet and the electrical connecting pin of the electrical connecting terminal are formed on the side of the base, and the electrical connecting pin is disposed close to a root portion of the elastic sheet.

7. The electrical connection arrangement as claimed in claim 5, wherein the base has a frame shape.

8. The electrical connection arrangement as claimed in claim 5, wherein the elastic sheet has a curved shape, and the elastic sheet is formed with a groove.

9. An electrical connection arrangement comprising an electrical connecting terminal for connecting a driving board with a lamp holder of an LED lamp, wherein a lamp adaptor is mounted to the lamp holder to receive and fix the driving board in a space formed in an interior of the lamp adaptor, and the electrical connecting terminal comprises a positive electrode connecting terminal for connection of the driving board and a positive electrode of the lamp holder and a negative electrode connecting terminal for connection of the driving board and a negative electrode of the lamp holder and cooperates with an integral plastic core; the integral plastic core is fixed on the driving board, the integral plastic core is formed with an insertion hole for insertion of the positive electrode of the lamp holder, a side of the insertion hole is formed with a side trough in communication with the insertion hole, the integral plastic core is further formed with an insertion slot, an outer wall of the insertion slot is formed with an oblique surface and a step; wherein the base of the positive electrode connecting terminal is inserted into the side trough in a direction from the interior of the lamp adaptor of the LED lamp towards the lamp holder, the electrical connecting pin is formed on the side of the base towards the interior of the lamp adaptor of the LED lamp, the electrical connecting pin is exposed out of the integral plastic core for electrically connecting with the driving board, the elastic sheet is formed on the side of the base towards the lamp holder, the elastic sheet is inserted into the insertion hole and extends and curves towards the interior of the lamp adaptor of the LED lamp, the elastic sheet is elastically in contact with the positive electrode inserted in the insertion hole for electrical connection such that the elastic sheet is deformable in a direction away from the interior of the lamp adaptor and toward the driving board; and wherein the base of the negative electrode connecting terminal is inserted into the insertion slot in a direction from the lamp holder towards the interior of the lamp adaptor of the LED lamp, the electrical connecting pin being formed on the side of the base towards the lamp holder, the electrical connecting pin is exposed out of the integral plastic core for electrically connecting with the driving board, the elastic sheet is formed on the side of the base towards the lamp holder, the elastic sheet extends out of the insertion slot and curves towards the inside of the LED lamp, a root portion of the elastic sheet is against the outer wall of the insertion slot or a head portion of the elastic sheet is against the outer wall of the insertion slot, the elastic sheet is elastically in contact with the negative electrode of the lamp holder for electrical connection, and the head portion of the elastic sheet is engageable with and hook the step.

10. The electrical connection arrangement as claimed in claim 9, wherein the base of each of the positive electrode connecting terminal and the negative electrode connecting terminal has a frame shape.

11. The electrical connection arrangement as claimed in claim 9, wherein the elastic sheet of each of the positive electrode connecting terminal and the negative electrode connecting terminal has a curved shape, and the elastic sheet is formed with a groove.

12. The electrical connection arrangement as claimed in claim 9, wherein the elastic sheet and the electrical connecting pin of the positive electrode connecting terminal are formed on the side of the base, and the electrical connecting pin is disposed close to a head portion of the elastic sheet and apart from a root portion of the elastic sheet.

13. The electrical connection arrangement as claimed in claim 9, wherein the elastic sheet and the electrical connecting pin of the negative electrode connecting terminal are formed on the side of the base, and the electrical connecting pin is disposed close to a root portion of the elastic sheet.

* * * * *